US007368648B2

(12) United States Patent
van der Meulen

(10) Patent No.: US 7,368,648 B2
(45) Date of Patent: May 6, 2008

(54) SET OF CLAVE BLOCKS

(75) Inventor: Jan Roelof van der Meulen, Brunssum (NL)

(73) Assignee: Pearl Musical Instrument Co., Chiba (JP)

( * ) Notice: Subject to any disclaimer, the term of this patent is extended or adjusted under 35 U.S.C. 154(b) by 387 days.

(21) Appl. No.: 10/782,806

(22) Filed: Feb. 23, 2004

(65) Prior Publication Data

US 2005/0150351 A1 Jul. 14, 2005

Related U.S. Application Data

(60) Provisional application No. 60/536,257, filed on Jan. 14, 2004.

(51) Int. Cl.
*G10D 13/08* (2006.01)

(52) U.S. Cl. ..... 84/402; 84/410

(58) Field of Classification Search ..... 84/402, 84/403, 406, 410

See application file for complete search history.

(56) References Cited

U.S. PATENT DOCUMENTS 976,718 A * 11/1910 Bartholomae ..... 446/422
3,595,119 A * 7/1971 Kuijpers ..... 84/403
3,766,683 A 10/1973 Vennola
3,828,468 A 8/1974 Palumbo
3,893,363 A * 7/1975 Cohen ..... 84/402
4,217,807 A * 8/1980 Nutting et al. ..... 84/402
4,362,080 A * 12/1982 DeArmas ..... 84/406
4,779,507 A * 10/1988 Shimoda et al. ..... 84/402
4,898,061 A * 2/1990 Cohen et al. ..... 84/402
5,484,320 A 1/1996 Becker
6,020,546 A * 2/2000 Cohen et al. ..... 84/402
6,091,009 A * 7/2000 Simons et al. ..... 84/402
6,271,449 B1 * 8/2001 Enhoffer et al. ..... 84/402
6,489,546 B2 12/2002 Enhoffer et al.

* cited by examiner

*Primary Examiner*—Lincoln Donovan
*Assistant Examiner*—Jianchun Qin
(74) *Attorney, Agent, or Firm*—Berenato, White & Stavish

(57) ABSTRACT

A percussion musical instrument comprising a set of clave blocks each comprising a body having an open cavity therewithin. The bodies of the clave blocks have substantially equal exterior dimensions and assorted volumes of the open cavities therewithin provided to generate musical tones of assorted pitches, such as low pitch, medium pitch and high pitch. A volume of the open cavity of the low pitch clave block of the set is larger than a volume of the open cavity of the medium pitch clave block, while the volume of the open cavity of the medium pitch clave block is larger than a volume of the open cavity of the high pitch clave block. Each of the clave blocks of the set further includes a mounting rings.

8 Claims, 3 Drawing Sheets

SET OF CLAVE BLOCKS

CROSS-REFERENCE TO RELATED APPLICATION

This Application claims the benefit under 35 U.S.C. 119(e) of U.S. Provisional Application No. 60/536,257 filed Jan. 14, 2004 by Jan Roelof van der Meulen.

BACKGROUND OF THE INVENTION

1. Field of the Invention

The present invention relates to percussion musical instruments in general, and more particularly to a percussion musical instrument comprising a set of clave blocks.

2. Description of the Prior Art

It known to those skilled in the art of music that clave is a five-note, two-bar rhythm pattern, or the beat arrangement, which generates rhythmic measurement and is the foundation and backbone of Salsa (and all Afro-Cuban based music) that makes the sound unique and which makes the dance styling different from American/European popular dances. There are 4 common rhythms, the Rumba and Son clave and a ⅝ (or "Afro") variation of each. In "Salsa," the Son Clave is prevalent. Clave rhythm is the basis of Afro-Latin musical styles and is considered the key, the identity, the root, and the "soul" of the music.

Correspondingly, the musical instrument generating that sound is known in the art as a clave instrument. The clave instrument typically comprises a clave block and a striking bar used to strike the clave block to generate the clave rhythm.

SUMMARY OF THE INVENTION

The present invention provides a novel percussion musical instrument. The percussion musical instrument of the present invention includes a set of clave blocks each comprising a body having an open cavity therewithin. The bodies of the clave blocks have substantially equal exterior dimensions and assorted volumes of the open cavities therewithin provided to generate musical tones of assorted pitches.

The set of clave blocks in accordance with the preferred embodiment of the present invention includes three clave blocks: a low pitch clave block provided to generate a low pitch tone, a medium pitch clave block provided to generate a medium pitch tone and a high pitch clave block provided to generate a high pitch tone. A volume of the open cavity of the low pitch clave block of the set is larger than a volume of the open cavity of the medium pitch clave block, while the volume of the open cavity of the medium pitch clave block is larger than a volume of the open cavity of the high pitch clave block.

Preferably, the bodies of the clave blocks are made of plastic material by injection molding process.

Each of the clave blocks of the set further includes a mounting rings.

BRIEF DESCRIPTION OF THE DRAWINGS

Other objects and advantages of the invention will become apparent from a study of the following specification when viewed in light of the accompanying drawings, wherein.

DETAILED DESCRIPTION OF PREFERRED EMBODIMENTS

The preferred embodiment of the present invention will now be described with the reference to accompanying drawings.

The present invention is a percussion musical instrument comprising a set of clave blocks each designed to generate a clave rhythm of different pitch. The percussion musical instrument in accordance with the preferred embodiment of the present invention includes the set of three clave blocks: a low pitch clave block, a medium pitch clave block, and a high pitch clave block. It will be appreciated that the set of clave blocks including two clave blocks or more than three clave blocks will be within the scope of the present invention.

Figure 1A:
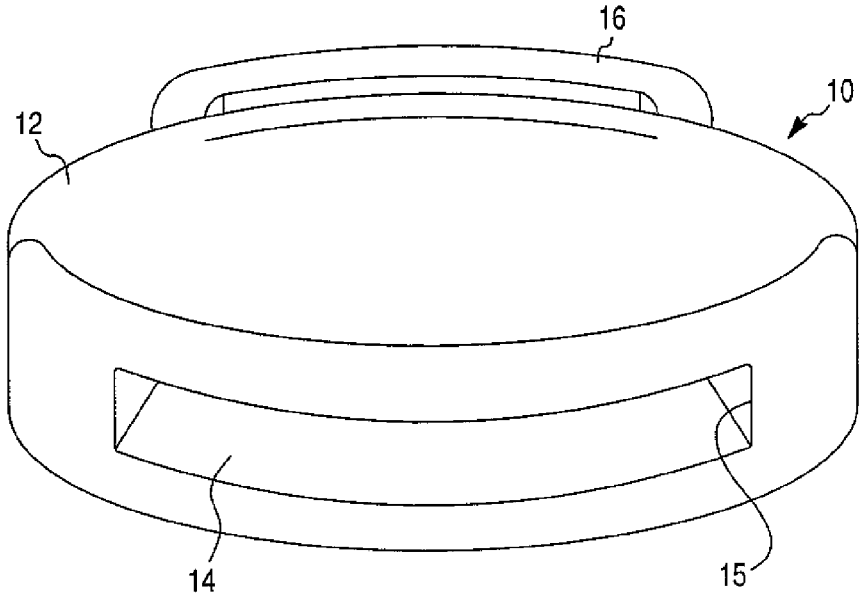
FIG. 1A is a perspective view of a low pitch clave block in accordance with a preferred embodiment of the present invention.
Figure 1B:
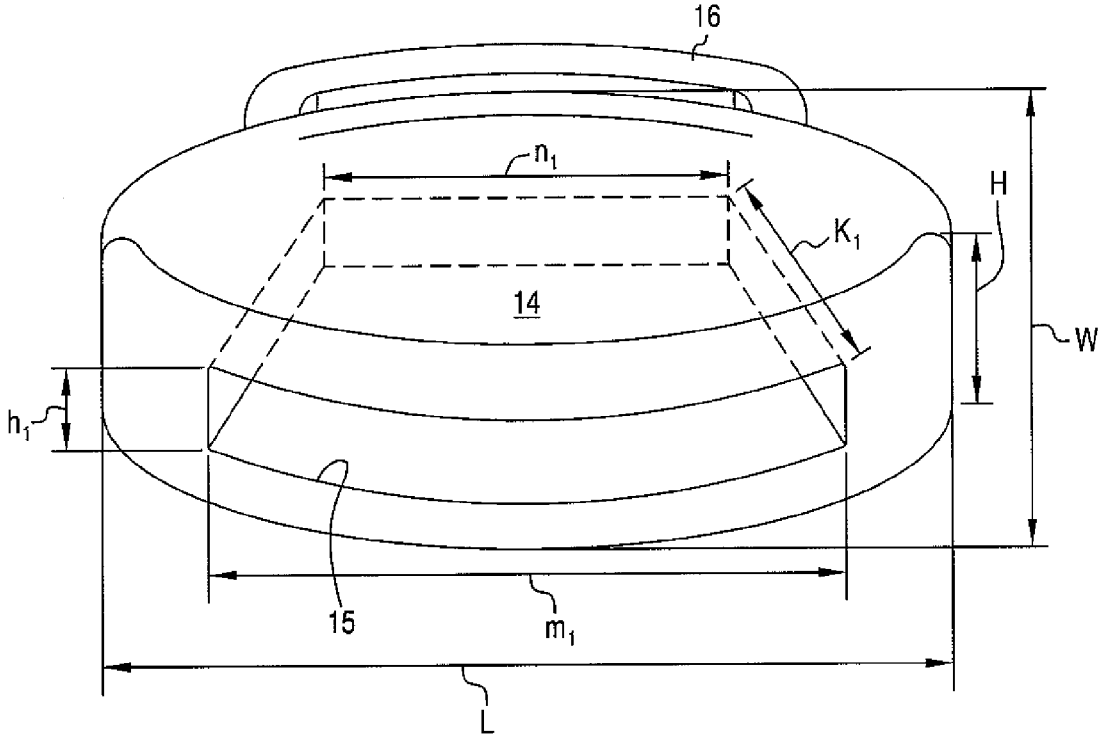
FIG. 1B is a perspective view of the low pitch clave block in accordance with the preferred embodiment of the present invention showing an open cavity therewithin in dash lines.

FIGS. 1A and 1B illustrate the low pitch clave block generally represented by reference numeral 10. The low pitch clave block 10 includes a rigid body 12 formed with an open cavity 14 therewithin. The low pitch clave block 10 further includes a mounting ring 16. Preferably, the mounting ring 16 is formed integrally with the body 12 of the clave block 10. Further preferably, the clave block 10 is made of plastic material by an injection molding process. It will be appreciated that the clave block 10 may be manufactured of any appropriate solid material and process known to those skilled in the art. As illustrated in FIGS. 1A and 1B, the body 12 of the clave block 10 has a shape of a substantially elliptical cylinder and is characterized by external dimensions L, W and H. As shown in FIG. 1B, the open cavity 14 within the body 12 is in the form of a substantially trapezoidal polyhedron characterized by dimensions $m_1$, $n_1$, $k_1$ and $h_1$, which define a volume $V_1$ of the open cavity 14 within the low pitch clave block 10.

Figure 2A:
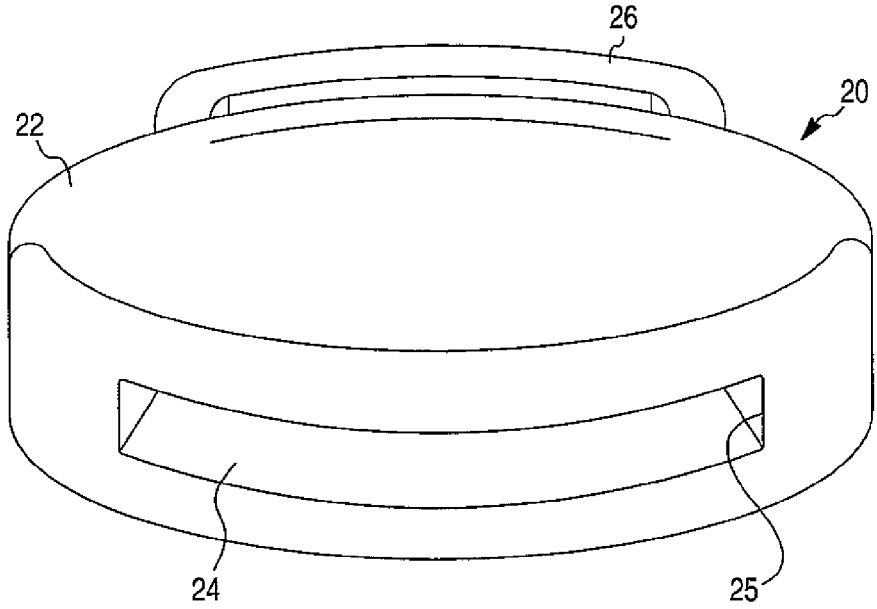
FIG. 2A is a perspective view of a medium pitch clave block in accordance with the preferred embodiment of the present invention.
Figure 2B:
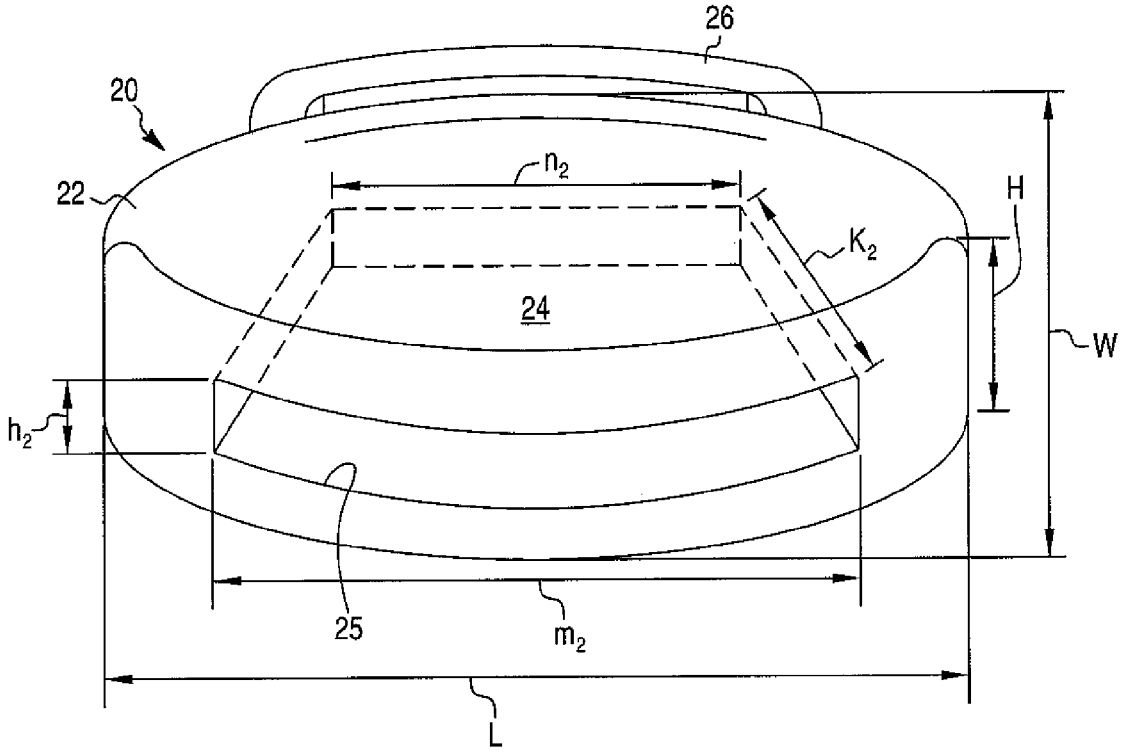
FIG. 2B is a perspective view of the medium pitch clave block in accordance with the preferred embodiment of the present invention showing an open cavity therewithin in dash lines.

FIGS. 2A and 2B illustrate the medium pitch clave block generally represented by reference numeral 20. The medium pitch clave block 20 includes a rigid body 22 formed with an open cavity open cavity 24 therewithin. The medium pitch clave block 20 further includes a mounting ring 26. Preferably, the mounting ring 26 is formed integrally with the body 22 of the clave block 20. Further preferably, the clave block 20 is made of plastic material by an injection molding process. It will be appreciated that the clave block 20 may be manufactured of any appropriate solid material and process known to those skilled in the art. As illustrated in FIGS. 2A and 2B, the body 22 of the clave block 20 has a shape of a substantially elliptical cylinder and is characterized by external dimensions L, W and H. As shown in FIG. 2B, the open cavity 24 within the body 22 is in the form of a substantially trapezoidal polyhedron characterized by dimensions $m_2$, $n_2$, $k_2$ and $h_2$, which define a volume $V_2$ of the open cavity 24 within the medium pitch clave block 20.

Figure 3A:
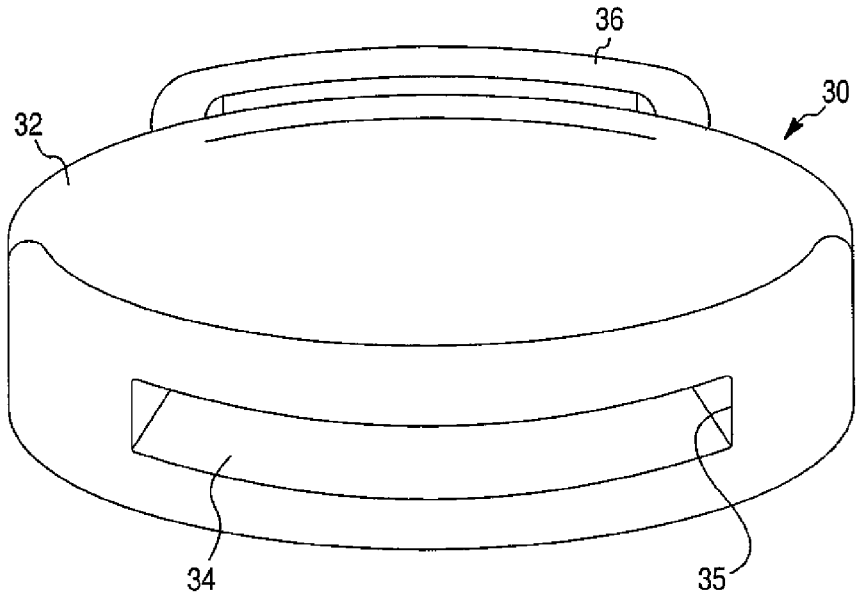
FIG. 3A is a perspective view of a high pitch clave block in accordance with the preferred embodiment of the present invention.
Figure 3B:
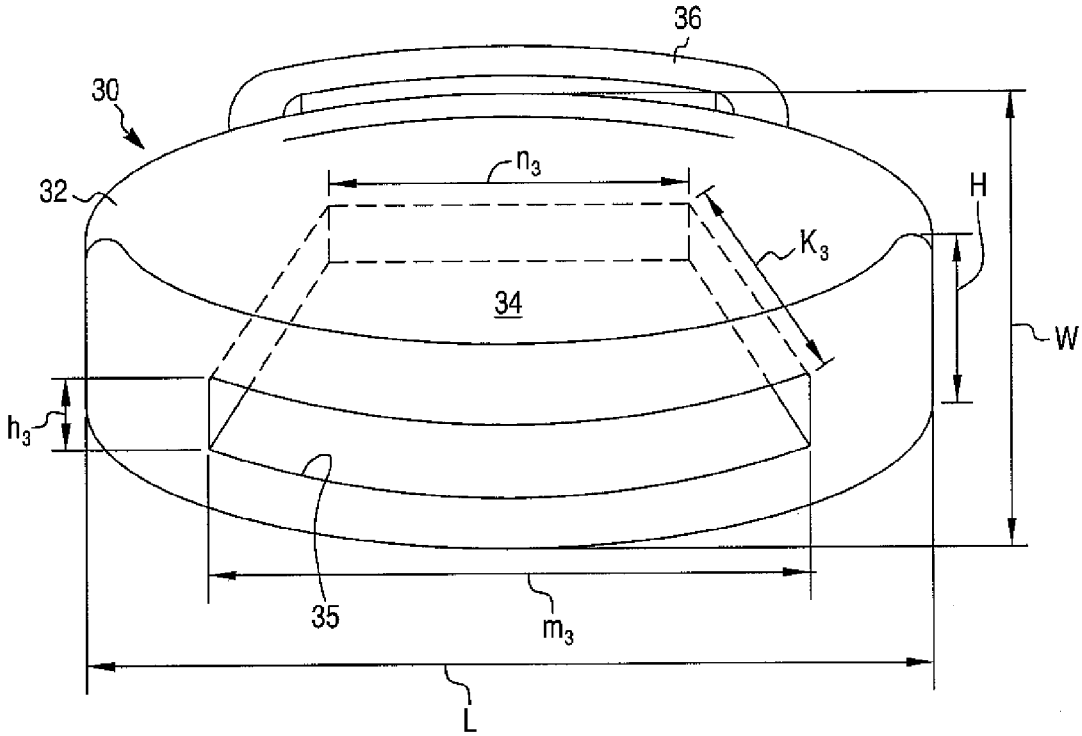
FIG. 3B is a perspective view of the high pitch clave block in accordance with the preferred embodiment of the present invention showing an open cavity therewithin in dash lines.

FIGS. 3A and 3B illustrate the high pitch clave block generally represented by reference numeral 30. The high pitch clave block 30 includes a rigid body 32 formed with an open cavity 34 therewithin. The high pitch clave block 30 further includes a mounting ring 36. Preferably, the mounting ring 36 is formed integrally with the body 32 of the clave block 30. Further preferably, the clave block 30 is made of plastic material by an injection molding process. It will be appreciated that the clave block 30 may be manufactured of any appropriate solid material and process known to those skilled in the art. As illustrated in FIGS. 3A and 3B, the body 32 of the clave block 30 has a clave block 30 has a shape of a substantially elliptical cylinder and is characterized by external dimensions L, W and H. As shown in FIG. 3B, the open cavity 34 within the body 32 is in the form of a substantially trapezoidal polyhedron characterized by dimensions $m_3$, $n_3$, $k_3$ and $h_3$, which define a volume $V_3$ of the open cavity 34 within the high pitch clave block 30.

In accordance with the present invention, the exterior dimensions of the bodies of all three clave blocks 10, 20 and 30 are substantially identical and characterized by external dimensions L, W and H. On the other hand, volumes of the open cavities 14, 24 and 34 of the clave blocks 10, 20 and 30 are substantially different. More specifically, as the clave block 10 is provided to generate a low pitch tone, the volume $V_1$ of the cavity 14 is larger than the volume $V_2$ of the cavity 24 of the clave block 20 is provided to generate a medium pitch tone. Correspondingly, as the clave block 30 is provided to generate a high pitch tone, the volume $V_3$ of the cavity 34 is smaller than the volume $V_2$ of the cavity 24 of the medium pitch clave block 20. In other words, $$V_1 > V_2 > V_3.$$

In other words, a perimeter of an opening 15 in the low pitch clave block 10 is bigger than a perimeter of an opening 25 in the medium pitch clave block 20, while the perimeter of the opening 25 in the medium pitch clave block 20 is bigger than a perimeter of an opening 35 in the high pitch clave block 30. Correspondingly, a thickness of the body 12 of the low pitch clave block 10 is smaller than a thickness of the body 22 of the medium pitch clave block 20, while the thickness of the body 22 of the medium pitch clave block 20 is smaller than a thickness of the body 32 of the high pitch clave block 30.

For this reason, the dimensions characterizing the open cavities 14, 24 and 34 of the clave blocks 10, 20 and 30, respectively, are subject to the following equations:

$$m_1 > m_2 > m_3;\ n_1 > n_2 > n_3;\ k_1 > k_2 > k_3;\ \text{and}\ h_1 > h_2 > h_3.$$

Therefore, the present invention represents a novel arrangement of the percussion musical instrument including set of clave blocks, wherein all of the clave blocks have substantially identical exterior dimensions, but assorted (or different) volumes of open cavity specifically designed to generate clave rhythms of a variety of pitches.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A percussion musical instrument comprising:

a set of clave blocks each comprising a rigid body made of a solid material, said body having an open cavity therewithin defined solely by said solid material;

said bodies having substantially equal exterior dimensions and different volumes of said open cavities therewithin provided to generate musical tones of a variety of pitches.

2. The musical instrument as defined in claim 1, wherein said set includes three clave blocks including a low pitch clave block provided to generate a low pitch tone, a medium pitch clave block provided to generate a medium pitch tone and a high pitch clave block provided to generate a high pitch tone.

3. The musical instrument as defined in claim 2, wherein a volume of said open cavity of said low pitch clave block of said set is larger than a volume of said open cavity of cavity of said medium pitch clave block, and wherein said volume of said open cavity of said medium pitch clave block is larger than a volume of said open cavity of said high pitch clave block.

4. The musical instrument as defined in claim 1, wherein said body of at least one of said clave blocks has a mounting ring.

5. The musical instrument as defined in claim 1, wherein said body of each of said clave blocks is made of plastic material.

6. The musical instrument as defined in claim 1, wherein said body of each of said clave blocks is made by injection molding process.

7. The musical instrument as defined in claim 1, wherein said bodies of different volumes having different thickness of said solid material.

8. The musical instrument as defined in claim 1, wherein said cavities include openings having different perimeters.

* * * * *